United States Patent [19]

Brusasca et al.

[11] Patent Number: 4,599,961

[45] Date of Patent: Jul. 15, 1986

[54] SEWING MACHINE THREAD CHAIN CUTTER

[75] Inventors: Gianfranco Brusasca, Cornaredo; Franco Garzulano, Galliate, both of Italy

[73] Assignee: Rockwell-Rimoldi S.p.A., Italy

[21] Appl. No.: 745,457

[22] Filed: Jun. 17, 1985

[30] Foreign Application Priority Data

Nov. 9, 1984 [IT] Italy ..... 23739/84[U]

[51] Int. Cl.[4] ..... D05B 65/06

[52] U.S. Cl. ..... 112/287; 112/DIG. 1; 83/98

[58] Field of Search ..... 112/287, 288, DIG. 1; 83/98, 99, 100

[56] References Cited

U.S. PATENT DOCUMENTS

| | | | |
|---|---|---|---|
| 3,025,811 | 3/1962 | Kostenowczyk | 112/288 |
| 3,143,987 | 8/1964 | Daniel et al. | 112/288 X |
| 3,511,202 | 5/1970 | Strauss et al. | 112/288 X |
| 3,749,040 | 7/1973 | Jurgens | 112/288 X |
| 4,091,756 | 5/1978 | von Hagen | 112/288 X |

*Primary Examiner*—Werner H. Schroeder
*Assistant Examiner*—Andrew M. Falik

[57] ABSTRACT

A thread cutting device for industrial sewing machines having an elongated, unitary body, a compressed air passage, a simple vent hole and a cutting blade aligned parallel to the elongated body and pivotally mounted for cooperation with a fixed cutter blade.

4 Claims, 4 Drawing Figures

SEWING MACHINE THREAD CHAIN CUTTER

BACKGROUND OF THE INVENTION

FIELD OF THE INVENTION

The present invention relates to a thread-cutting device which has an improved structure and which is designed in particular for use on industrial sewing machines, for example sewing machines for producing the so-called overage stitch.

DESCRIPTION OF THE PRIOR AND RELATED ART

A device similar to that described and claimed in the present application can be found in Applicant's copending U.S. application Ser. No. 725,072.

As is known, the thread-cutting devices which are commercially available nowadays come in various forms: some suck in the thread chin to be cut by means of a vacuum pump; others, however, obtain this suction effect by means of a Venturi tube, i.e. a shaped tube into which pressurized air is introduced and from which there extends, laterally to the direction of flow of the air, a suction mouth facing the fabric being sewn.

Moreover, some thread-cutting devices are arranged along the working surface of the sewing machine, below the surface over which the fabric is fed, whereas others are arranged on one edge of the working surface and have a suction mouth which is raised relative to the said working surface.

The thread-cutting devices which use a Venturi tube to suck in the thread chain to be cut and which, moreover, are arranged on one edge of the working surface, with the suction mouth in a raised position, are those which provide the best results in the opinion of the Applicants themselves.

In fact, these devices are able to obtain a powerful suction effect using very simple means, and the compressed air can also be used, via a suitable external vent, to control directly the movements of the thread chain and blow back the latter on the fabric being sewn so as to fix it by means of the stitches themselves.

Moreover, the fact that the device is positioned on the side of the working surface, instead of being embedded in the latter, prevents the fabric becoming caught up during sewing.

However, even the thread-cutting devices of the said type, i.e. those which use a Venturi tube, possess drawbacks: in particular, the said devices are complex and costly to manufacture. In practice, to achieve a good suction effect in the case of a particularly wide suction mouth, the internal vent or nozzle from which the pressurized air is emitted must be given a complex shape.

In the known embodiments, this internal vent consists of an appropriately shaped small cylinder which has inside it a passage for the pressurized air, which in turn emerges on a generatrix of the cylinder itself.

The thread-cutting device must therefore be made from several elements which are joined together in succession.

Until today, it appeared that this situation could not be remedied, since the size of the mouth is a decisive factor for ensuring insertion of the thread chain to be cut and cannot be reduced.

Cutting is performed by means of a cutting element or blade which is able to swing angularly between a position where it is partially embedded in the device and a position outside the latter. It must also be pointed out that the said blade of the thread-cutting device in question needs to be frequently checked and serviced since it can easily accumulate fine dust particles produced as a result of cutting the thread chains as well as the fabric in general. These fine dust particles can hinder the movements of the blade and in particular can prevent it assuming its closed position inside the thread-cutting device.

Finally, it must be pointed out that, in some cases, the projecting position of the thread-cutting device relative to the working surface can give rise to problems: consequently it appears suitable to position the thread chain cutter so that its suction mouth is flush with the working surface therefore appears to be preferable.

SUMMARY OF THE INVENTION

In view of the above, the general object of the present invention is to provide a new thread-cutting device which, on account of its improved structure, overcomes substantially the abovementioned drawbacks.

Within the scope of this general object, an important object of the present invention is to design a very simple device which can be easily manufactured, at a low cost, by the industries in the sector.

These and other objects which will become more apparent below are achieved by a thread-cutting device with an improved structure, intended in particular for industrial sewing machines, of the type comprising a rigid casing fixed on one edge of the working surface of the machine in a position adjacent to the fabric being sewn, a discharge tube extending from one end of the said casing to a suction mouth located on the latter and facing the said fabric, a blower apparatus supplied with compressed air and comprising at least one internal vent located in the said suction mouth and designed to direct the compressed air along the said discharge tube, and a cutting element which is able to swing to and fro and is arranged in the region of the said mouth, wherein the said blade element consists of a blade which is hinged with the said casing and mainly extends in a substantially straight line, and wherein the said blade, when in the closed position where it is fully inserted inside the said casing, is arranged so as to block a substantially large part of the said suction mouth.

BRIEF DESCRIPTION OF THE DRAWINGS

Further characteristic features and advantages will become clearer from the description of a thread-cutting device according to the invention, which is illustrated by way of example in the attached drawings in which.

DESCRIPTION OF THE PREFERRED EMBODIMENT

Figure 1:
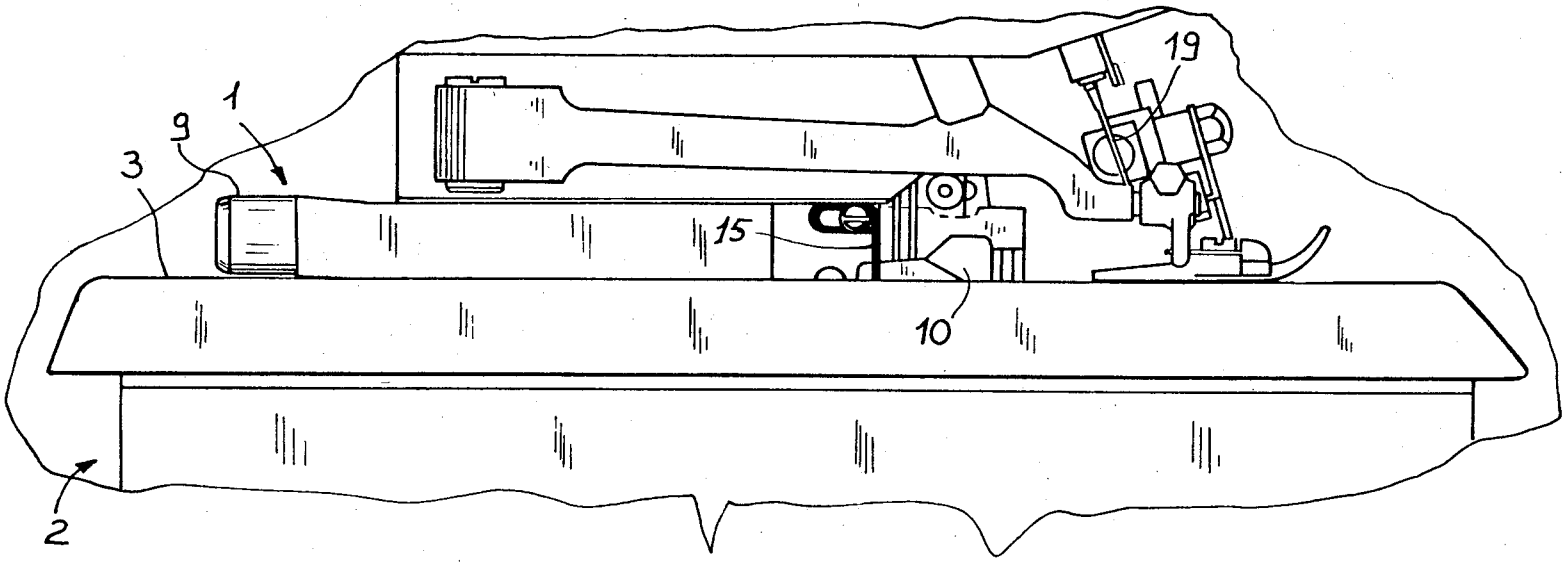
FIG. 1 is a side view of a sewing machine of the industrial type, provided with the thread-cutting device which is the subject of the present invention.
Figure 2:
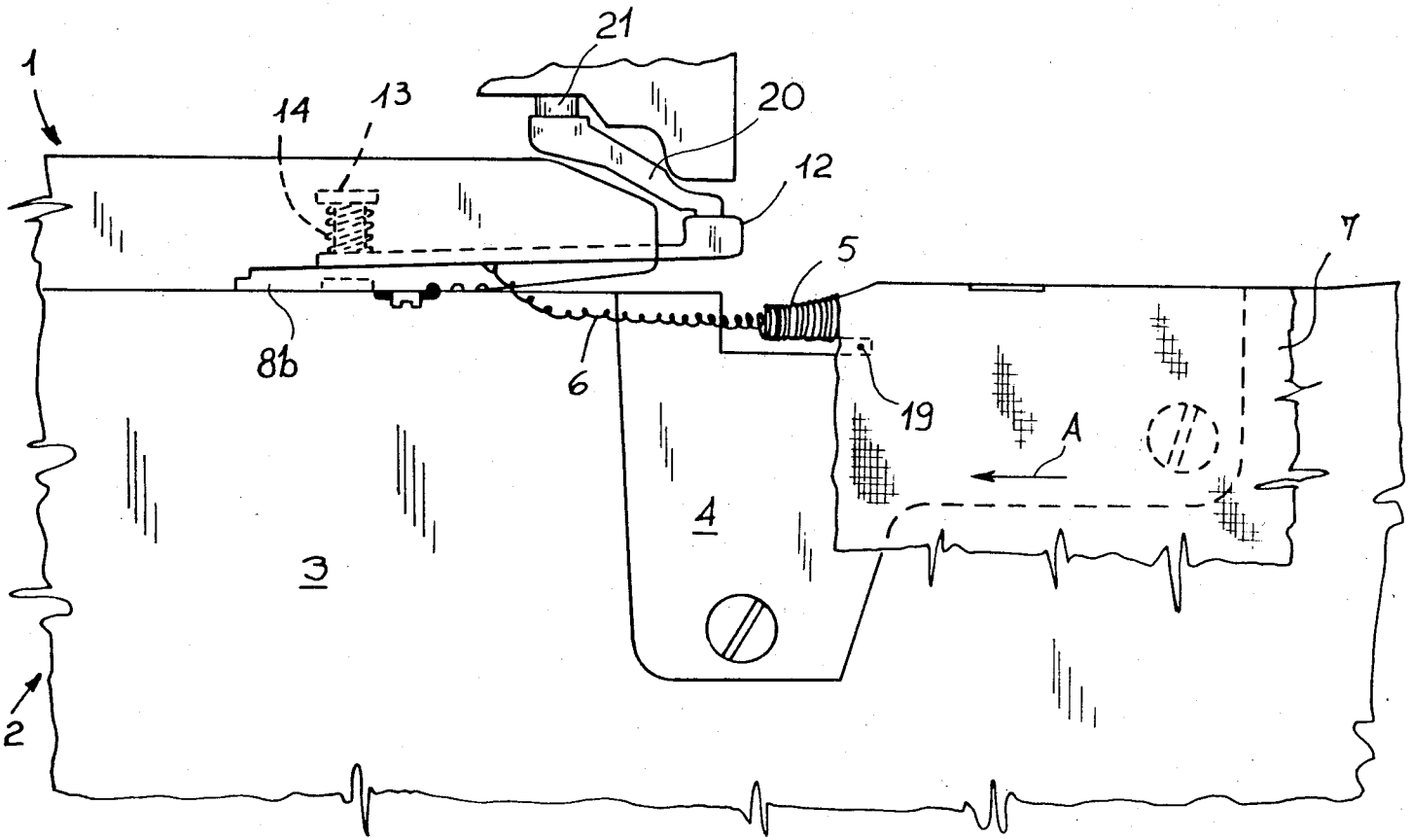
FIG. 2 is a plan view, on an enlarged scale, of part of the sewing machine shown in FIG. 1.

With reference to the abovementioned figures, the thread-cutting device which is the subject of the present invention is indicated in its entirety by the reference number 1. It is applied to one edge of the working surface 3 of an industrial-type sewing machine 2. As shown in FIG. 2, the thread-cutting device 1 is immediately adjacent to the needle plate 4 provided with a tongue 5 on which the thread chain 6 to be cut is initially formed.

During sewing, the fabric 7 moves forward in the direction of the thread-cutting device 1.

The thread-cutting device 1 consists, in outline, of a casing 8 provided with a discharge tube 9 which extends from a first end 8*a* of the casing 8 to a suction mouth 10. Pipe 11, which is connected to a source of compressed air at one end, is provided with an internal vent 16 at its other end. The internal vent 16 points toward the end 8*a* in order to send a compressed air jet along the discharge tube 9 and away from the suction mouth 10. The compressed air tube 11 is formed in the thickness of the lower wall in the discharge tube 9, but its acutal location is not important for the purposes of the present application; what is important, on the contrary, is the fact that the casing 8 is of one piece construction. Therefore the compressed air tube 11 formed on the casing 8 starts in the region of the rear end 8*a*, where it is operatively connected with any known compressed air generator, as hereinbefore specified, and debouches into the discharge tube 9 with the vent hole 16.

The effect of the rapid expansion of the compressed air coming out of vent 16 results in a venturi effect which in turn creates a vacuum, in the region behind suction mouth 10. This suction causes the thread chain to be drawn inside discharge tube 9 as soon as it is opposite suction mouth 10. Once the thread chain has entered suction mouth 10 it is subject to the blast of compressed air coming from vent 16 and blown toward the other end of discharge tube 9.

Figure 3:
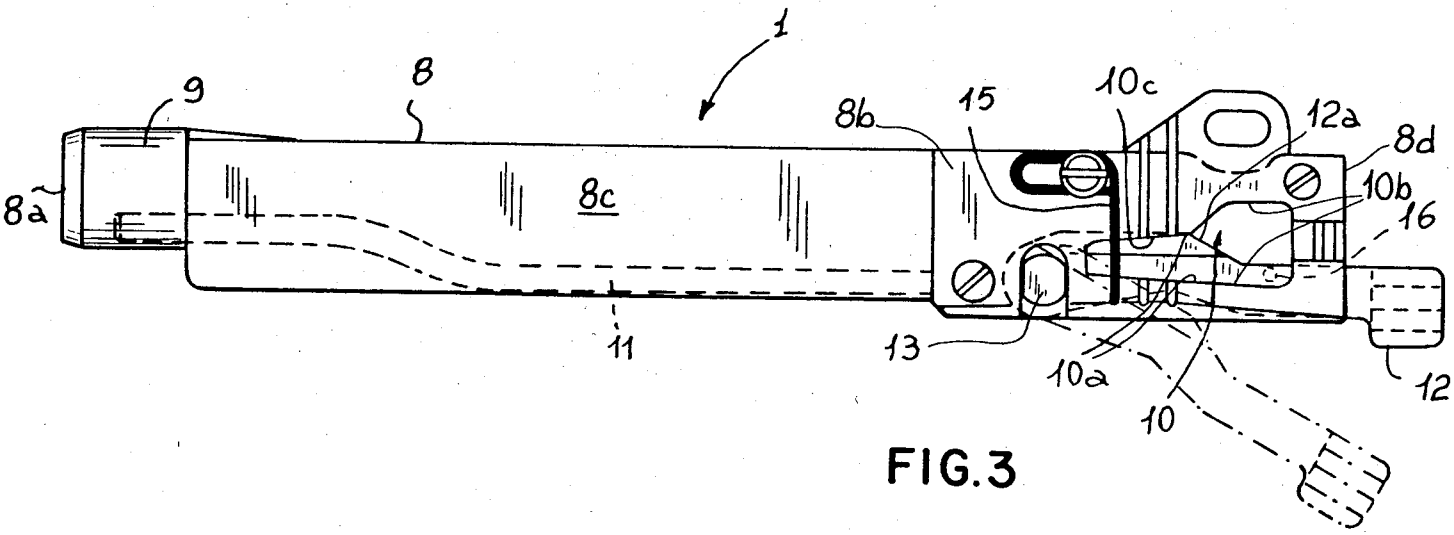
FIG. 3 is an isolated view of the thread-cutting device.

A cutting element 12, which pivots on a pin 13 and acted on by a compression spring 14, is able to swing from a closed position where it is partially inserted inside the casing 8 into an open position indicated by the dot-dash line in FIG. 3.

Said suction mouth 10 comprises a first slot or zone 10*a* which extends substantially horizontally and parallelly to the direction in which the sewn fabric 7 moves forward (arrow A). The upper edge 10*c* delimitating said slot is suitably sharpened so that it defines the cutting edge of the stationary blade which, together with the movable blade 12, constitutes the cutting mechanism of the thread chain cutter 1. When the thread chain 6 is sucked into the casing 8 through the suction mouth 10, said thread chain enters the slot 10*a* because it is brought close thereto by the fabric 7 moving forward and it is therefore cut by said cutting mechanism due to the fact that the movable blade 12 comes into contact with the cutting edge 10*c*. But the suction mouth 10 also comprises a second wide opening or zone 10*b* which widens out, starting from the lower edge of the slot 10*a*, towards the front end 8*d* of the casing 8 and in an upward direction so that it extends higher than the cutting edge 10*c* and can form the additional always open opening above the upper edge 12*a* of the movable blade 12, which additional opening is the one that allows the thread chain cutter 1 to suck in also the fine dust particles present in the environment surrounding said cutter. Also, a small rod 15 can be positioned over the suction mouth 10 so as to prevent the fabric being accidentally sucked into the mouth itself. In an original manner, the blade 12 mainly extends in a substantially straight line and is hinged with the casing 8 so that, when it is in the said closed position where it is fully inserted inside the casing itself, a substantially large portion of the suction mouth 10 is blocked.

FIG. 3 shows that, in the embodiment shown, the blade 12, when in the closed position, not only completely blocks the first zone 10*a* of the suction mouth 10, and hence cuts the thread chain in conjunction with the cutting edge 10*c*, but also blocks part of the second zone 10*b* of the suction mouth itself.

Figure 4:
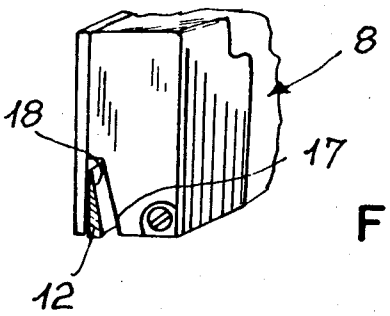
FIG. 4 shows, on an enlarged scale, an end part of the thread-cutting device shown in FIG. 3, in the region of the cutting element.

Advantageously, in this arrangement, the said, internal vent consists of a hole 16 located at the rear end of the suction mouth 10 and moreover, advantageously, the casing 8 consists of a body made in a single piece. In practice, the casing 8 is shaped so as to define in itself the discharge tube 9 located at the exit end of casing 8, the compressed-air supply pipe 11, the suction mouth 10 and the hole 16. FIG. 4 also shows that the casing 8 has a widened recess 17 designed to accommodate, with play, the blade 12. Moreover, the blade 12 has a beveled cross-section 18 corresponding to the widened recess 17: together the widened recess 17 and beveled cross-section 18 define a through-opening in the direction of the suction mouth, which is designed to prevent fine dust accumulating in the region of the blade 12.

Moreover, the latter is sharpened in the upper zone which makes contact with the casing 8. Operation of the thread-cutting device is as follows: In a manner known per se, the thread chain 6 is formed on the tongue 5 shortly before the needle engages with the fabric 7. Then, feeding of the fabric 7 causes the thread chain 6 to unwind itself from the tongue 5; feeding of the thread chain into the suction mouth 10 is caused by the suction effect caused by the compressed air emerging from the hole 16. At this point, the thread chain enters the discharge tube 9 and is cut by the blade 12 which is actuated by means known per se partially shown in FIG. 2. The actuation means partially shown in FIG. 2 consists of an arm 20 operatively connected, for example, to the shaft 21 driving the trimming knife of the machine (not shown). The insertion or drawing of the thread chain 6 the suction mouth 10 and the discharge tube 9 is ensured by the same blade 12 which performs the cutting operation. The alternate opening and closing movements of the said blade obstruct, in fact, the suction mouth 10, thereby increasing the suction effect. The partial closure of the suction mouth 10 facilitates insertion of the thread chain 6 for two reasons: the first is that the closing movements are alternated with opening movements; the second is that the closing movement increases the sucking action on the thread chain and leaves the second zone 10*b* of the suction mouth 10 unobstructed, in particular the upper zone of the latter, which zone is necessary for fabrics of considerable thickness in order to prevent the mouth being completely closed by the latter.

The main advantage of the increase in the suction effect, which is obtained in an original manner by the said arrangement of the blade 12, is that a hole 16 can be used as the compressed-air vent and, consequently, that the entire thread-cutting device can be formed as a single piece, with no complicated parts which have to be made separately.

Moreover, the through-opening formed in the region of the blade 12 gives rise to a small continuous flow of air through the opening itself: fine dust is thus prevented from accumulating in the region of the blade 12.

In the embodiment illustrated, the thread-cutting device is also arranged, advantageously, in a substantially lowered position, the bottom edge of the suction chamber being level with the working surface 3.

This device does not create any problems as regards operation; in fact, the amount by which the device projects vertically relative to the working surface, is reduced.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

We claim:

1. A thread chain cutter for sewing machines of the type comprising stationary and movable cutting means and a casing fixed on one edge of the working surface of the machine in a position adjacent to the fabric being sewn, in which provision is made for a discharge tube provided with a suction mouth oriented towards the said fabric, and further comprising a tube producing compressed air and terminating with at least a vent hole disposed inside said discharge tube in a rearward position with respect to said suction mouth and oriented towards a rear portion of said discharge tube in order to produce a Venturi effect and therefore a suction action on the thread chain passing before said suction mouth, a movable blade operations in said suction mouth and being part of said movable cutting means for said thread chain to be cut, said movable blade being hinged on said casing inside said discharge tube, wherein said movable blade mainly extends in a substantially straight line and wherein said movable blade, when in its position of maximum closure on said suction mouth, completely closes a first zone of said suction mouth, which zone the upper edge of which defines the stationary cutting means extends like a substantially horizontal slot parallel to the direction in which the fabric being sewn is fed, and partially blocks a second wide zone which widens out starting from the lower edge of said first zone towards the fornt end of said casing and in an upward direction so that it extends higher than the upper edge of said first zone in order to suck in the fine dust particles in the region of said thread chain cutter.

2. A device as claimed in claim 1, wherein the said casing consists of a body which is made as a single piece and in which are formed the said discharge tube, the said suction mouth and a compressed-air supply pipe leading to the said vent in the said suction mouth.

3. A device as claimed in claim 1, wherein the said casing includes a widened recess designed to accommodate, with play, the said blade and to form a through-opening in the direction of the said suction mouth so as to prevent the accumulation of fine dust on the blade itself.

4. A device as claimed in claim 3, wherein the said blade has, in the region of the said through-opening, a cross-section which is beveled.

* * * * *